US007004753B2

(12) United States Patent
Stockhausen

(10) Patent No.: US 7,004,753 B2
(45) Date of Patent: Feb. 28, 2006

(54) GAS SEAL FOR REACTORS EMPLOYING GAS GUIDE BODIES AND REACTOR HAVING THE GAS SEAL

(75) Inventor: Frank Stockhausen, Thierhaupten (DE)

(73) Assignee: SGL Carbon AG, Meitingen (DE)

( * ) Notice: Subject to any disclaimer, the term of this patent is extended or adjusted under 35 U.S.C. 154(b) by 242 days.

(21) Appl. No.: 10/701,060

(22) Filed: Nov. 4, 2003

(65) Prior Publication Data

US 2004/0214124 A1 Oct. 28, 2004

Related U.S. Application Data

(63) Continuation of application No. PCT/EP02/04036, filed on Apr. 11, 2002.

(30) Foreign Application Priority Data

May 12, 2001 (DE) ..... 101 23 241

(51) Int. Cl.
*F27B 9/28* (2006.01)

(52) U.S. Cl. ..... 432/59; 344/444; 344/643

(58) Field of Classification Search ..... 432/8, 432/59; 264/173.14, 173.15, 210.7, 235.8, 264/290.2; 34/444, 448, 459, 463, 640, 643
See application file for complete search history.

(56) References Cited

U.S. PATENT DOCUMENTS

| | | | | |
|---|---|---|---|---|
| 4,545,762 | A * | 10/1985 | Arita et al. | 432/59 |
| 5,908,290 | A * | 6/1999 | Kawamura et al. | 432/59 |
| 5,928,986 | A | 7/1999 | Parmentier et al. | |
| 6,027,337 | A | 2/2000 | Rogers et al. | |
| 6,776,611 | B1 * | 8/2004 | Sprague | 432/64 |

FOREIGN PATENT DOCUMENTS

| | | |
|---|---|---|
| DE | 33 12 683 A1 | 10/1984 |
| JP | 60238426 A | 11/1985 |

* cited by examiner

*Primary Examiner*—Gregory Wilson
(74) *Attorney, Agent, or Firm*—Laurence A. Greenberg; Werner H. Stemer; Ralph E. Locher

(57) ABSTRACT

A gas seal protects the material inlet openings and material outlet openings of reactors for treating strands of material and strips of material. The openings are sealed by gas curtains. These curtains are generated by gas streams that leave gas outlet openings or nozzles and that are directed at an angle into the interior of the furnace. According to the invention, gas guide bodies, which extend adjacent the strands of material or strips of material substantially parallel to the surfaces of these strands of material and strips of material in the direction of the interior of the reactor, are mounted at the gas outlet openings. The gases leaving the gas outlet openings are guided in the gas guide spaces that are formed between the gas guide bodies and the strands or strips of material, in a targeted manner and under a slightly raised pressure in the direction of the interior of the reactor and thereby effect a significantly improved gas seal.

53 Claims, 8 Drawing Sheets

4
5
6
1
4
2
15
10"
12
13
9"
8*
17'
16
17
12
7
13
13
12
10'
16
13
10*
8
12
13
14
7
16
8
13
12
10*
12
13
9'
12
13
16
8
9*
13
12
10*
3

GAS SEAL FOR REACTORS EMPLOYING GAS GUIDE BODIES AND REACTOR HAVING THE GAS SEAL

CROSS-REFERENCE TO RELATED APPLICATION

This application is a continuation of copending International Application No. PCT/EP02/04036, filed Apr. 11, 2002, which designated the United States and was not published in English.

BACKGROUND OF THE INVENTION

1. Field of the Invention

The present invention relates to a gas seal for a reactor for treating strands or strips of material, in which the reactor has the following features. The invention also relates to a reactor having the gas seal.

The reactor has an outer jacket that extends parallel to the transportation direction of the strands or strips of material, as well as a front wall and a rear wall or an upper and a lower seal wall. Either the front wall or the rear wall or the front wall and the rear wall or either the upper or the lower seal wall or both seal walls have at least one opening for the introduction of at least one strand of material or strip of material and/or at least one opening for the removal of at least one strand of material or strip of material.

The reactor has devices for the transportation of strands of material or strips of material through the reactor and devices for transporting strands of material or strips of material to the reactor and for transporting strands of material or strips of material from the reactor.

The reactor has devices for heating the reactor interior or parts thereof and/or for heating strands of material or strips of material or parts thereof or for cooling the reactor interior or parts thereof and/or strands of material or strips of material or parts thereof, or does not have such devices.

The reactor has devices for supplying temperature-regulated or non temperature-regulated gases to the reactor space and/or for removing gases from the reactor space.

The reactor has, at those places at which at least one strand of material or strip of material enters the reactor space and/or at which at least one strand of material or strip of material leaves the reactor space, through openings, a gas feedline and distribution device with gas discharge openings. The distribution device allows gas to flows out at these openings for the material inlet or outlet to generate a gas curtain. The gas curtain prevents the penetration of undesirable substances into the reactor space as well as the exit of undesirable substances from the reactor space.

For the treatment of endless strands of material or strips of material, for example at elevated temperatures under continuous operation, reactors are used through which this endless material is drawn by transportation devices. Generally, the transportation devices can be motor-driven and velocity-regulated uncoiling and coiling devices generally provided with rollers. The strands or strips are in this connection either drawn only once or, which is more often the case, are drawn several times in succession through the reactor. In the latter case for reasons of the economy of the process, the strands or strips of material are, after the first passage through the reactor, fed again immediately into the reactor generally by reversing rollers and are transported once more through the reactor. This operation is repeated as often as required by the process procedure. In many cases, the reactors not only constitute equipment in which the strands or strips are subjected to specific temperatures for the execution of desired physical procedures, but also chemical reactions proceed in parallel to the temperature treatments, for the execution of which reactions reactants, generally in gaseous or vapor form, are often introduced into the reactor and, after a specific residence time, are removed from the reactor, possibly together with resulting reaction products. If the gas space in the interior of the reactor contains gases or vapors that are toxic or corrosive or that for other reasons must not be discharged into the atmosphere surrounding the reactor, all the inlets and outlets at which the strands or strips of material are conveyed into the reactor or are conveyed from the reactor must be sealed so that no harmful or negative effects on humans, material or the environment outside the reactor can take place.

Several technical solutions to this problem exist. For example, gas-lock boxes may be employed at the material inlets and outlets from which the gases and vapors leaving the reactor are removed by suction and are then rendered harmless. However, due to their bulk, such gas-locks interfere with the outlet or inlet openings for the strands or strips of material, and a further disadvantage is the fact that, in order reliably to remove the harmful substances, large amounts of foreign or ballast gases have to be sucked into the gas-lock and then handled. In addition, part of the gases and vapors present in the interior of the reactor is sucked into the gas-lock space and is then lost for purposes of reutilization and/or recycling. The latter disadvantage applies to gas-lock spaces operating under reduced pressure. Gas-locks operating under an excess gas pressure occupy even more space than "reduced pressure gas-locks" because, with this solution, the reversing rollers for the strands or strips of material have to be located within the gas-lock chamber. If this were not the case and if for example the gas-lock chambers had through passages for the strands and strips of material, some of the harmful substances would undesirably exit through these passages. In addition, in the case of "excess pressure gas-locks" the strands or strips of material may possibly not be visually checked or checked only inadequately. Then, the operating workforce can no longer carry out directly and/or cannot carry out sufficiently rapidly the control, regulatory, and preventative interventions on the strands or strips that are necessary with the processes taking place in the reactors. In another type of procedure so-called gas curtains are employed. In this case, at the openings at which the strands or strips of material are transported into the reactor or are transported from the latter, a harmless gas is blown through suitable openings or nozzles into the furnace openings and onto the strands or strips of material in such a way that a gas flow is produced that is directed substantially into the interior of the furnace and, in the manner of a dynamic curtain, prevents the harmful gases and vapors from leaving the reactor.

As will be shown hereinafter, the hitherto known seals using gas curtains also do not operate satisfactorily.

U.S. Pat. No. 5,928,986 to Parmentier et al. describes a furnace for the oxidizing activation of the fiber surfaces of carbon fibers or yarns in the carbonized state with a suitable gas at temperatures of 800° to 1000° C. At the inlet opening and the outlet opening for the strand of material, the furnace has gas-lock chambers that are equipped with cooling and suction systems. The gases leaving the furnace and entering the gas-lock chambers are sucked out via the suction systems and rendered harmless. According to another technical variant, an inert gas can be blown into the gas-lock chambers. This inert gas serves to generate a gas curtain there and prevent the uncontrolled penetration of air into the interior of the furnace. This gas, too, is for the most part sucked out from the gas-lock chambers. Here, in each case too, gas-lock chambers are therefore involved whose gaseous contents are sucked out. In the first case the gas leaving the furnace and in the second case a rinsing gas that is introduced into the gas-lock chambers are sucked out together with the gases originating from the furnace. If in this case a gas curtain is generated at all, then it occurs in a gas-lock chamber and not at the actual entry to the working space of the furnace.

German Published, Non-Prosecuted Patent Application No. DE 33 12 683 A1 discloses a vertical throughflow furnace for the production of carbonized carbon fibers from so-called preoxidized fibers. The production process is carried out in the temperature range from 300° to 1500° C. The preoxidized fibers required for the execution of the process are produced in an upstream process stage by treating organic fibers, made from for example polyacrylonitrile, at temperatures of up to 300° C. The fibers are infusible. The treatment of the fibers in the carbonization furnace takes place under a protective gas. For this, protective gas is blown in at the lower material outlet of the furnace in a manner not described in more detail, the gas rising upwardly in the furnace. Provided in the vicinity of the heating zones, which are located at a relatively large distance from the inlet and outlet openings for the fiber strip, are nozzles through which nozzles temperature-regulated protective gas is blown in so that a gas curtain is generated within the heating chambers or heating zones. Just underneath these nozzles are installed suction openings. A large part of the blown-in protective gas that is now charged with gaseous and vaporous reaction products from the carbonization process is removed through the suction openings. The purpose of this gas curtain is to prevent harmful, in particular tar-containing decomposition products, flowing upwardly within the vertical furnace into the cooler, upper furnace zones. The furnace should thereby not be sealed against the outside.

A gas curtain that is operated at the material entry points and outlets of the furnace and thus not directly in its reaction space and that does not employ gas-lock chambers has been described in U.S. Pat. No. 6,027,337 issued to Rogers et al. The furnace is used for the production of carbon fibers from polyacrylonitrile fibers, preferably for the production of preoxidized and thus non-meltable fibers in the temperature range from ca. 150° to 300° C. In this connection, the fibers are exposed to an air current. In the reactions that thereby take place, very poisonous gases such as hydrogen cyanide or carbon monoxide are also released, in addition to steam and carbon dioxide, and must in no event, and not even in very small amounts, pass untrapped into the space outside the furnace. The technical solution employed here provides an air feedline and distribution device that is equipped with outlet openings for the air, specifically with wide slit-shaped nozzles, at each point at which a material strip is transported into or transported from the furnace. In order to generate the gas curtain that is intended to seal the interior of the furnace against the external atmosphere, gas is blown through these nozzles at a specific angle in the direction of the interior of the furnace. An air current that is overwhelmingly directed into the interior of the furnace and that acts as a gas curtain is thereby formed at the side of the openings for the fiber strands or fiber strips facing the interior of the furnace. This technical solution too unfortunately does not completely fulfill its expectations for it has been found in everyday operational use that the concentrations of harmful gases in the vicinity of the inlet and outlet openings for the strips of material were too large.

SUMMARY OF THE INVENTION

It is accordingly an object of the invention to provide a gas seal for reactors employing gas guide bodies and a reactor having a gas seal that overcome the hereinaforementioned disadvantages of the heretofore-known devices of this general type and that seal the inlet and outlet openings for strands or strips of material in reactors in which the strands or strips of material are treated in any way that reliably reduces to safe levels the undesirable escape of gases from the reaction space of the reactor at the aforementioned openings.

With the foregoing and other objects in view, there is provided, in accordance with the invention, a gas seal including a deflector or gas guide body. The deflector or gas guide body extends in the direction of the interior of the reactor. Viewed in the direction of the interior of the reactor, the deflector or gas guide body is disposed behind the gas discharge openings of the gas feedline and distribution device. The deflector or gas guide body is disposed at a distance from the surfaces of the strands or strips of material. The surface or surfaces of the deflector or gas guide body that are adjacent the strands or strips of material lies/lie at the same geometrical level as the gas discharge openings of the gas feedline and distribution device or at a level different from the geometrical level of the gas discharge openings.

The term "strands of material or strips of material" is understood within the context of the present invention to denote any material in filament, fiber, yarn, knitted or fabric form, in the form of random layers/plies, in the form of filaments, fibers, yarns, bonded or joined together by a textile process, such as for example woven fabrics, and furthermore in the form of films, laminates or sheets, which can be transported through openings into a reactor in order to be treated therein and that after such a treatment can be transported from the reactor. Materials of this type may for example be formed from plastics, glass, ceramics, carbon, natural or synthetic fibers, rubber, or also of composite materials of widely differing types. For the sake of simplicity, the term strips of material is used hereinafter for all these type of materials.

The term reactor is understood within the context of the present invention to mean a space enclosed by walls with inlets and outlets for the material that is to be treated and inlets and outlets for the operating devices that are necessary for the intended treatment. This reactor also includes all the necessary equipment for the respective operation, such as for example measurement, control and transporting devices, guide, conveying and treatment systems for gases and vapors, heating, cooling, and energy utilization units, and/or equipment for operational safety and environmental protection. Such reactors often operate at elevated temperatures and are therefore regarded as furnaces. Within the context of the invention, the strips of material may be transported horizontally (horizontal reactor) or vertically (vertical reactor) through the reactor. Where it is expedient, the transportation level for the strips of material may even be inclined or curved. The reactors may also be provided with devices for circulating the gaseous contents of the reactor interior.

The term deflector or gas guide body is understood within the context of the present invention to mean a body shaped in a certain way that is installed either at or immediately next to a gas feedline and distribution device of the reactor. For simplicity, only the term gas guide body will be used hereinafter for the terms deflector and gas guide body.

The gas feedline and distribution device distributes the gas that is required for the generation of the gas curtain uniformly over the whole width of the inlet and outlet openings for the strips of material. The device is furthermore equipped over the whole width of the inlet and outlet openings for the strips of material with one or more openings that may preferably be in the shape of a nozzle. These nozzles may be of any suitable shape. The nozzles are spatially aligned in a specific way in order to generate and maintain a predetermined directed gas flow. Their gas channels and/or gas outlet openings may not have corners, being, for example round or elliptical, or are, for example, orthogonally angular such as for example square or rectangular, or also may have more than four angles. The gas outlet openings may be level or inclined or have a special profile. According to an advantageous embodiment, the nozzles are slit-shaped and extend over the whole width of the inlet or outlet openings. The gas exit channel of the nozzles may be straight or curved, depending on whether or not the gas flow is in addition to be given a specific orientation or a specific torque. The gas with which the gas curtain is to be generated is blown by these gas outlet nozzles into the furnace at a specific angle and with a specific velocity. Further details are incorporated by reference from U.S. Pat. No. 6,027,337, which is accordingly introduced into the description. In the present invention, this angle formed by the gas stream directed into the interior of the reactor, depending on the position of the gas outlet openings or nozzles, either with the surface of the strip of material or with the surface of the directly adjacent gas guide body, is preferably in the range from thirty to sixty degrees (30° to 60°), and particularly preferably in the range from forty to fifty degrees (40° to 50°). Advantageously, the gas stream leaves with an initial velocity that is in the range from 50 to 140 m/sec. The gas guide bodies extend, spaced apart from the strips of material, over a specific length in the interior of the furnace. The bodies are mounted so that they form a channel or gas guide space together with the in each case closest strips of material, or in the case of at least partially gas-permeable strips of material, with the gas guide bodies that are situated spaced apart on the in each case other side of the relevant strips of material at the same inlet or outlet opening for the strips of material. In contrast to the prior art, the gas stream that is intended to generate the gas curtain now no longer discharges in an unguided manner into the large reactor interior where it would be dissipated in the form of eddies, resulting in turn in a back-transport of part of the harmful gases to the reactor openings. Instead, it is now trapped in the gas guide spaces located between the gas guide bodies and is led in a directed stream into the furnace. The gas pressure is somewhat higher in the furnace inside zones directly adjacent the material inlets and outlets than in the interior of the furnace. The height of the gas guide spaces is minimized, unless this is not appropriate for other reasons. The result is that harmful gases present in the furnace would have to "diffuse" into the gas guide spaces against the directed flow in order to reach the outside. However, this is technically not possible if the gas velocity in the gas guide spaces is uniformly distributed over their cross-section and is greater than the diffusion velocity of the outwardly driving gas molecules. These conditions are guaranteed by the solution according to the invention.

The gas feedline and distribution devices extend over the whole width of the inlet and outlet openings for the strips of material and are disposed parallel to their flat sides so that the gas outlet openings located on the latter can supply at least one material outlet opening or inlet opening on at least one side with "curtain gas". If the reactor has more than one opening for the material entry or exit, each gas feedline and distribution device is preferably equipped with two adjacent, parallel running rows of gas outlet openings or with two adjacent, parallel running slit-shaped nozzles extending over the whole width of the material inlet and outlet openings. One row of gas outlet openings or one slit-shaped nozzle thus supplies the gas guide space located between the gas guide body and the strip of material with gas at a first material inlet or outlet opening and the row of gas outlet openings adjacent thereto or the other slit-shaped nozzle corresponding to the latter supplies the gas guide space located there between the gas guide body and the strip of material with gas at the second material inlet or outlet opening located directly adjacent this first material inlet or outlet opening.

A gas feedline and distribution device thus supplies every two adjacent material inlet and outlet openings respectively with one half of its gas. This only applies to those material inlet and outlet openings that are not the first or last and border the reactor housing at their flat side. The gas guide bodies have the same width as the material inlet or outlet openings and are either secured to the gas feedline and distribution devices or are secured directly adjacent the latter. The bodies project over a defined length into the interior of the reactor and according to a particularly preferred embodiment maintain the same spacing relative to the strip of material. Their spacing relative to the strip of material may however differ on the two flat sides of the strip of material. In the normal case the minimum spacing of the surfaces of the gas guide bodies from the in each case adjacent surface of the strip of material is 5 mm. In special cases, it may be less than this. This spacing is preferably in the range between 15 and 40 mm. The length of the gas guide bodies, i.e. their extension from the gas outlet openings or nozzles in the direction of the reactor interior, may vary within certain limits. These limits are defined by the ratio of this length of the gas guide bodies to the spacing between the surfaces of the gas guide bodies and the surfaces of the strips of material directly adjacent thereto. This ratio is at most 10 to 1 and is preferably within the range 4 to 1 to 6 to 1. According to one embodiment of the invention, the gas guide bodies have a flat surface. According to another embodiment, their surface is curved. If their surface in the transverse direction, i.e. in the direction of the width of the material inlet or outlet opening or the width of the strip of material, is curved, the curvature may also be convex or concave. Such flexure is employed if the transporting or reversing rollers for the strips of material are "bunched", e.g. for technical process reasons, or if their diameter becomes steadily narrower from the outside inwards. Furthermore it is possible for the surface of the gas guide bodies, again referred to the transverse direction, i.e. the direction of the width of the material inlet or outlet opening or the width of the strip of material, to be convex on one side of the strips of material and to be concave on the other side. This is advantageous if the strips of material exhibit a certain sag along their width and if the spacing between the surfaces of the gas guide bodies and the strips of material is to be maintained constant. The surfaces of the gas guide bodies may also be curved in the longitudinal direction, i.e. starting from the material inlet or outlet openings in the direction of the interior of the reactor. Here too the two surfaces of the gas guide bodies that face one and the same strip of material may be shaped in a complementary manner, i.e. they follow the curvature or the sag of the strip of material, i.e. the upper surface is convex while the lower surface is concave. It may also be the case that the two surfaces of the two gas guide bodies that are adjacent one and the same strip of material are curved so that the gas guide space enclosed by them widens out towards the interior of the reactor. Such a biconvex or also a wedge-shaped contour of the gas guide bodies is used as a rule in order to generate specific velocity profiles in this gas guide space. Combinations of the aforedescribed surface shapes of the gas guide bodies are of course also possible. However, they are used only if this is technically appropriate and the necessary expense and effort is justified. It is generally advantageous to maintain the edges and/or corners of the gas guide bodies facing the interior of the reactor free of roughness or burrs or to round them off or angle them slightly. This is done in order to prevent abrasion or damage to the strips of material should these come into contact with the gas guide bodies. More generally, the surfaces of the gas guide bodies are smooth in order to prevent abrasion or damage to the strips of material and minimize a deposition or build-up of dirt and to facilitate cleaning. Advantageously the surfaces may be provided with an anti-adhesion coating or protected in a suitable way against corrosion. According to a preferred embodiment, a gas guide body is disposed on each side of each strip of material so that each strip of material at each material inlet and outlet opening runs in a gas channel that is bordered by the surfaces of two gas guide bodies. Where necessary or advantageous, an alternative solution may be adopted in which only one gas guide body is used on one side of the strip of material.

The shape and detailed execution of the gas guide bodies are governed by the structural and technical circumstances of the reactor. The gas guide bodies may have a closed shape, i.e. may enclose a hollow space, that has no communication or only a slight communication with the interior of the reactor, or they may be made from metal guide sheets or guide surfaces between which is located a space that freely communicates with the interior of the reactor. Closed systems are preferred if substances may be formed in the interior of the reactor that would undesirably be deposited in the dead zones of the interior not affected by the flow.

A gas guide body may be positioned in various ways in relation to the outlet openings for the gas that is intended to generate the gas curtain. On the one hand, it may be disposed on the same plane or the same geometrical level as these outlet openings and extend, spaced from the adjacent strip of material, in the direction of the interior of the reactor. In this case, the gas stream is first of all guided onto the strip of material, with at least part of the stream being reflected there and then conveyed in the gas guide channel to the interior of the reactor. Alternatively, the gas guide body may be disposed so that the outlet openings for the gas that is intended to form the gas curtain rise above the surface of the gas guide body, i.e. so that these openings at the reactor inlet project to a certain extent into the space between the gas guide body and the strip of material. The gas stream leaving the openings may in this configuration either be guided onto the strip of material, where at least a part of the stream is reflected and then conveyed in the gas guide space to the interior of the reactor, or the nozzles that terminate in the gas outlet openings may be curved so that the gas stream first of all strikes the surface of the gas guide bodies, is reflected from the latter, is next deflected at a lower flow pressure onto the strip of material, and then flows in the gas guide space to the interior of the reactor. According to a third possibility, the surface of the gas guide bodies adjoins the gas guide space projects above the gas outlet openings. In this case, the gas outlet openings are positioned slightly in front of the gas guide bodies and the gas stream is first of all blown onto the strip of material, from which at least a part of the stream is reflected, and then strikes the surface of the gas guide body with a reduced velocity and finally flows through the gas guide space into the interior of the reactor. This solution may be used in particular if the spacing between the strip of material and the gas guide body is to be kept particularly small. The shape, detailed execution and positioning of the gas guide bodies are governed according to the structural and technical circumstances of the reactor, and may be appropriately chosen by the person skilled in the art.

The gas guide bodies may be made from any material that is suitable for the process conditions for which they are intended. Because of the reduced effort and expenditure involved and the easier processability, they often are formed from a metal or a metal alloy such as iron, steel, stainless steel, copper, brass, bronze, aluminum, or an aluminum alloy. Where circumstances demand however, they may also include materials other than the aforementioned metals or metal alloys, for example of a ceramic material such as porcelain, stoneware, silicon carbide, carbon, graphite or glass. Composite materials such as, for example, plastics materials reinforced with fibers or carbon reinforced with fibers or inter-laminated layers of materials or even natural or synthetic substances from the group of thermoplastic materials and thermosetting materials such as for example fluoropolymers, fluoro-chloropolymers, polyamides, polyimides, polyvinyl chloride, polyethylene, phenolic, or epoxy resins may also be used if the conditions so require or permit. The surfaces of the gas guide bodies or the latter themselves may also be made from fibers, threads, yarns, or wires joined together as textiles may be. Various types of fabric are most commonly used for this purpose. However, non-woven materials and randomly configured layer materials may also be used for special cases. Such textile composites may be made from any materials that are suitable for this purpose, such as for example plastics fibers, natural or synthetic fiber materials, mineral, glass, silicon dioxide, silicon carbide, aluminum oxide, carbon or graphite fibers, or for example of steel, stainless steel, copper, brass, or bronze wires.

The temperature of the gas that is blown via the gas feedlines and distribution devices and the gas openings or the nozzles into the reactor in order to generate and maintain the gas seal is governed by the circumstances of the process sequence in the reactor. If the process sequence does not require any special relevant measures, the gas is at ambient temperature. If blowing in too cold a gas would interfere with the process or if a gas at elevated temperature were necessary or advantageous, then the gas is preheated. This is the case for example if an elevated temperature prevails in the reactor. A cold gas would in fact heat up on entering the hot reactor space and would thereby expand and build up an undesirable counter-pressure in the vicinity of the gas seal. A previously cooled gas is advantageously blown in if the material inlets and outlets of the reactor or the reactor itself need to be cooled. A correspondingly higher gas pressure must however be generated, if necessary, in the gas guide space due to the danger of the aforedescribed formation of a relatively large counter-pressure. According to a further advantageous variant of the invention, the gas seal is effected with a gas at least part of which has been withdrawn from the interior of the reactor. In this case, the energy content of this gas can be advantageously utilized provided that suitably insulated lines are employed. Of course, such a gas may not contain any constituents that must not be allowed to escape into the atmosphere outside the reactor. This is the case for example if simply a temperature treatment of a product is carried out under a protective gas in the reactor or if the gas has been purified during the treatment or after leaving the reactor in order to remove harmful substances. Such a purification is often carried out thermally by combustion in a post-combustion device. The heat energy that is thereby released may be utilized, according to a further, similarly advantageous variant of the invention, to heat up gas in known heat transfer devices that is then used to operate the gas seal. The same effect may also be achieved without a post-combustion device if gas with a sufficiently high thermal content is led from the reactor through a heat exchanger where the gas is at least partially heated and is then used to operate the gas seal.

According to a further modification of the invention, the gas guide bodies serve not only to maintain a reliable gas seal at the material inlet and outlet openings of the reactor. The gas guide bodies may also be configured as heating bodies or as cooling bodies in order either to heat up or to cool the gas that is required for the gas seal and that is blown into the reactor. If this temperature adjustment of the gas can be utilized for the processes occurring in the interior of the reactor, then it is eminently suitable also to introduce more gas in this way into the furnace than would be absolutely necessary in order to maintain the gas seal. An example of this is the maintenance of a specific temperature profile also in the vicinity of the ends of the reactor. For such intended applications, it may also be necessary, more than is specified for the preferred embodiment of the invention mentioned hereinbefore, to alter the ratio of the length of the gas guide bodies to their distance from the surface of the adjacent strip of material, in the direction of longer lengths of the gas guide bodies.

Other features that are considered as characteristic for the invention are set forth in the appended claims.

Although the invention is illustrated and described herein as embodied in a gas seal for reactors employing gas guide bodies and a reactor having the gas seal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
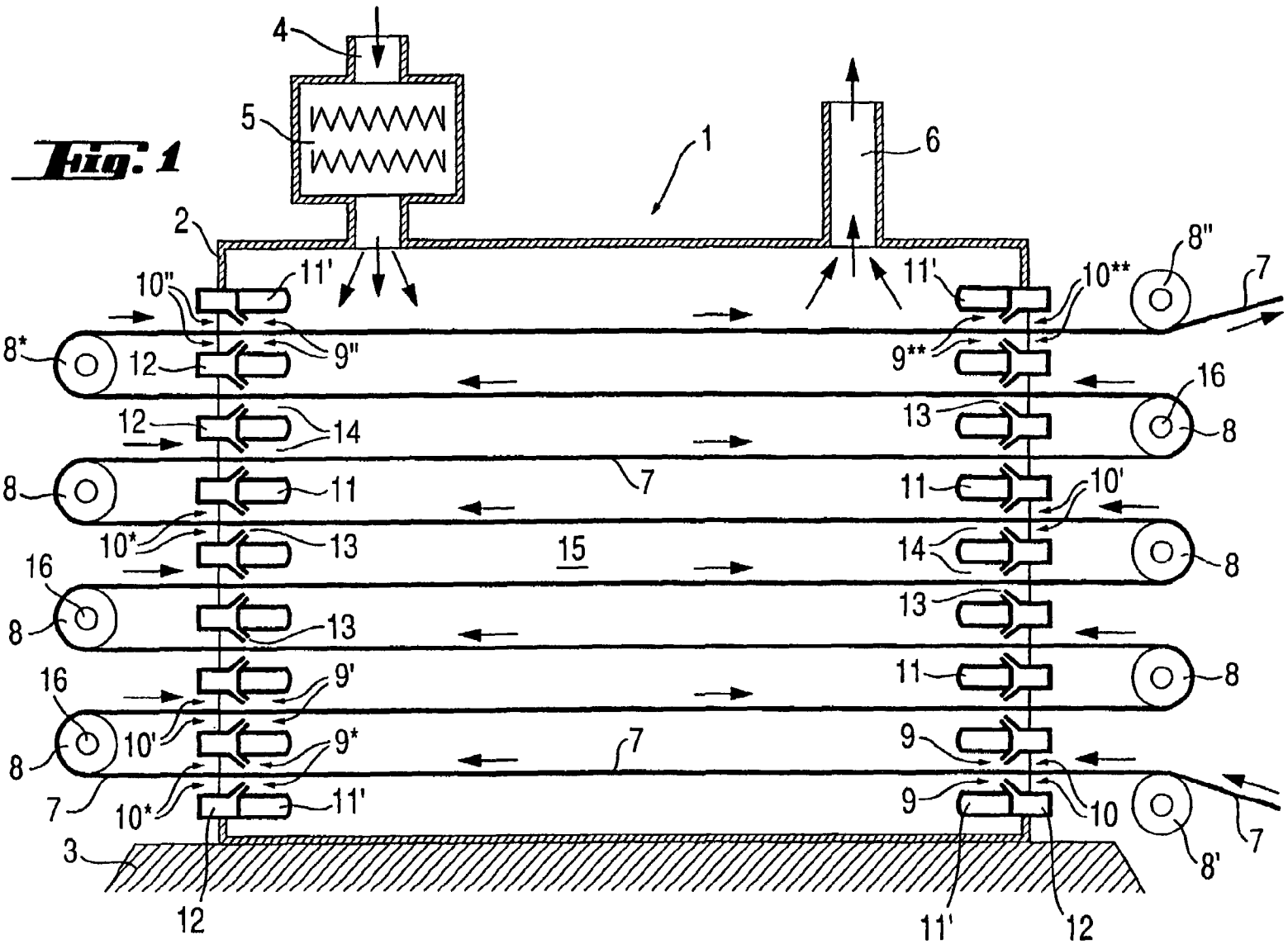
FIG. 1 is a diagrammatic, sectional view taken along the longitudinal axis of a reactor or furnace according to the invention for treating strips of material, in which the strips of material run horizontally through the reactor.

Referring now to the figures of the drawings in detail and first, particularly to FIG. 1 thereof, there is shown the reactor 1, which is surrounded by a housing 2 that stands on a foundation 3. The interior 15 of the reactor is charged with heated gas through the gas feedline 4 and a heating unit 5. Spent gas possibly charged with reaction products leaves the reactor 1 via the gas discharge 6 and can be passed to a material and/or heat recovery unit (not shown) or to a gas purification unit (also not shown). A strip of material 7 coming from an uncoiling device (not shown) is transported over the roller 8' located in front of the reactor space and through an opening 10 sealed with a gas curtain 9 into the reactor 1. The strip of material 7 passes through the reactor 1 and leaves the reactor 1 for the first time at the opening 10* likewise sealed with a gas curtain 9*. The strip 7 is then deflected by using the roller 8 also located outside the reactor 1 and reenters the reactor through the opening 10' that too is sealed by a gas curtain 9'. In this way, the strip of material 7 passes through the reactor 1 a total of eight (8) times, whereby the strip is reversed in each case by rollers 8; 8* and then enters the reactor 1 through openings 10' and leaves the reactor 1 through openings 10*. All the openings 10; 10'; 10"; 10*; 10 are sealed by gas curtains 9; 9'; 9"; 9*; 9**. After the end of the reaction the strip of material (7) leaves the reactor 1 for the last time at the opening 10**, which is sealed with the gas curtain 9**, and then runs over the roller 8" to a coiling device (not shown). Such a reactor may for example be a furnace for melting strips of polyacrylonitrile material in an air atmosphere, that is operated in the temperature range from ca. 180° to 320° C. The reactor may for example also be used at higher temperatures to carbonize fibers that have been rendered infusible and that may be present for example in the form of fiber, fabric or felt strips. The carbonization must be carried out of course in a non-oxidizing atmosphere. The gas guide bodies 11; 11' or deflectors 11; 11' according to the invention are located at the openings of the reactor 1 for the material inlet 10; 10', 10" and outlet 10*; 10**. Each of these openings 10; 10'; 10"; 10*; 10** is provided with a pair of such gas guide bodies 11 or 11; 11' so that gas can always flow from two sides over the strips of material 7, thereby ensuring a reliable gas seal of the interior of the reactor against the outer ambient atmosphere. In special cases (not shown here), for example where the strip of material rests on one side in a lapping/polishing manner on a material inlet or outlet opening over a relatively long section, possibly on a liquid film, blowing with gas on both sides may be omitted. In this case, a gas guide body is disposed only on one side of the strip of material. The gas that is required in order to maintain the gas curtains 9; 9'; 9"; 9*; 9** is led via gas feedline and distribution devices 12 that are formed as pipelines, to the material inlet openings 10; 10'; 10" and outlet openings 10*; 10**, where it is distributed uniformly over their width and then leaves the inlet and outlet openings 10; 10'; 10"; 10*; 10** via spatially directed nozzles 13 and is blown at a specific angle (see also FIG. 9) against the strips of material 7. At least part of the gas is deflected from these strips 7 and then flows at a gas pressure elevated relative to the interior of the reactor 15 into the gas guide spaces 14. The gas guide spaces 14 are formed either by the gas guide bodies 11 and the strips of material 7 or, in the case of very gas-permeable strips 7, are formed by two oppositely facing gas guide surfaces of adjacent gas guide bodies 11, and finally into the interior of the reactor 15. The gas guide bodies 11' at the uppermost and lowermost material inlet openings 10; 10" and outlet openings 10*; 10**, i.e. the gas guide bodies that have no strip of material on their side facing the reactor wall, only have gas outlet openings 13 or nozzles 13 on the side facing the strips of material 7 since only there does a gas curtain 9; 9"; 9*; 9**** have to be generated.

Figure 2:
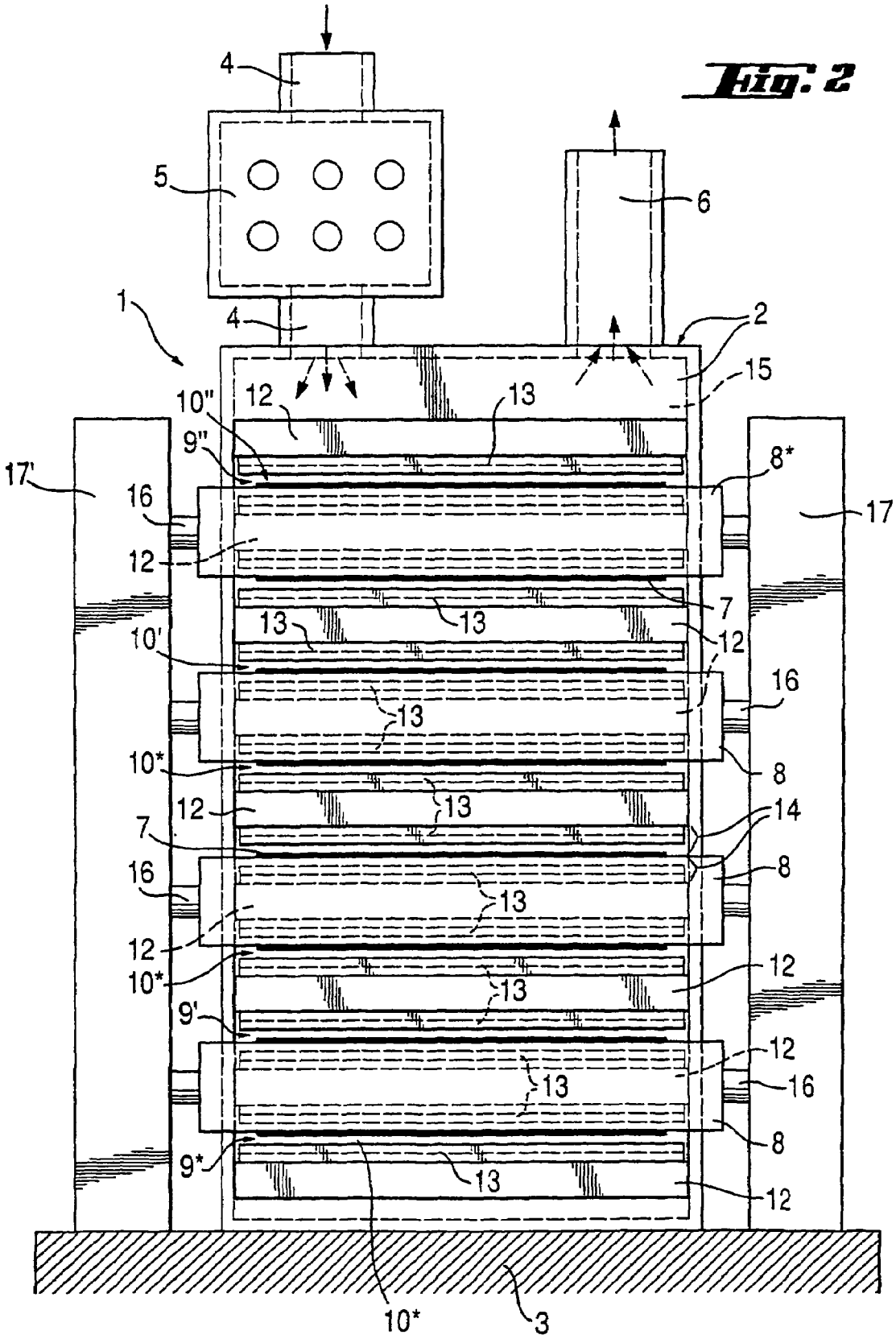
FIG. 2 is a plan view showing the rear face of the reactor according to FIG. 1.

FIG. 2 is a plan view of the rear face of a reactor 1 of the type described in FIG. 1. Here too, the reactor 1 has a reactor housing 2, a reactor foundation 3, a gas feedline 4 for the process gas, a heater 5 for the process gas, and a gas discharge 6 for the process gas. To the right and left of the furnace body can also be recognized the roller shafts 16 and the columns 17; 17' in which the bearings, the gear mechanism, and the drive for the rollers 8; 8* are accommodated. The strips of material 7 are conveyed into and from the reactor over the rollers 8; 8* at the inlet openings 10'; 10" and outlet openings 10*. The gas used for the generation of the gas curtain (Reference number 9 in FIG. 1) not visible here is pumped via the gas feedlines and distribution devices 12 into the gas outlet openings 13, which are formed in this case as slit-shaped nozzles extending over the whole width of the material inlet openings and outlet openings 10'; 10"; 10*. The gas leaves the latter in a spatially directed manner and forms the improved gas curtain in the gas guide spaces 14.

Figure 3:
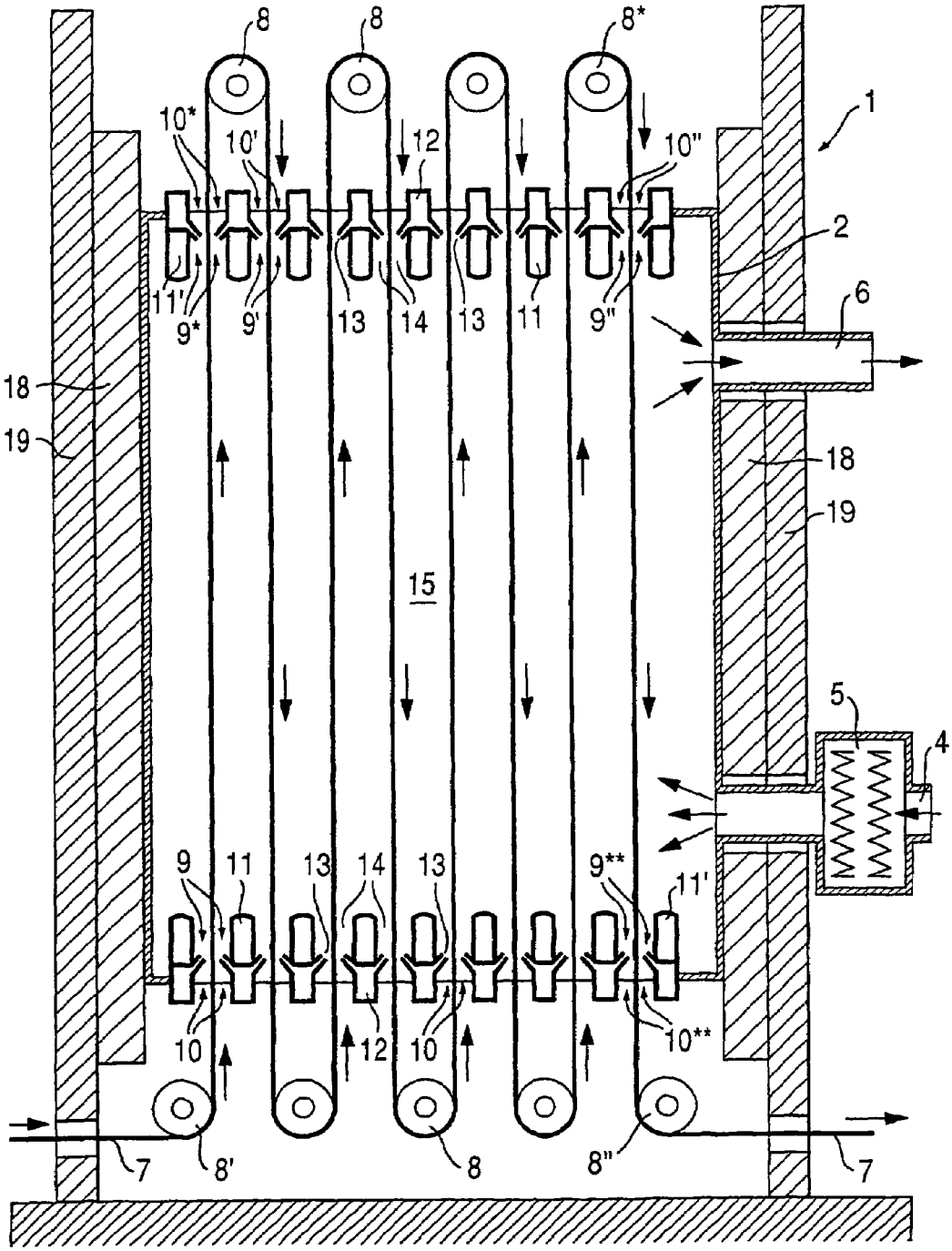
FIG. 3 is a sectional view showing a vertical reactor perpendicular to the width extent of the strips of material and to the width extent of the transporting and reversing rollers.

The reactor 1' shown in FIG. 3 is similar in configuration and construction to the reactor 1 shown in FIG. 1. The most important difference compared to the reactor 1 in FIG. 1 is that this reactor 1' is a vertical reactor in which the strips of material are either transported and treated in a single passage through the reactor 1' from below upwardly (not shown), or, as is illustrated in FIG. 3, are led several times through the reactor from below upwardly and from the top downwardly and are thereby treated, before leaving the reactor 1' again. In this connection, it is up to the person skilled in the art whether to introduce the strips of material from below into the reactor 1' and, as illustrated in FIG. 3, to withdraw them from below, or whether (which is not shown) to introduce them into the reactor 1' from above and also to remove them again at this side, or whether (which is likewise not shown) to introduce the strips at the bottom and remove them at the top, or vice versa. The reactor 1' has, as a variation of the reactor 1 shown in FIG. 1, in addition, a thermal insulation 18 and is mounted and installed in a support or frame 19. The other features are the same as those of the reactor 1 in FIG. 1. For the description, reference should be made to the details regarding FIG. 1, which in this connection should be adapted and modified as appropriate.

Figure 4:
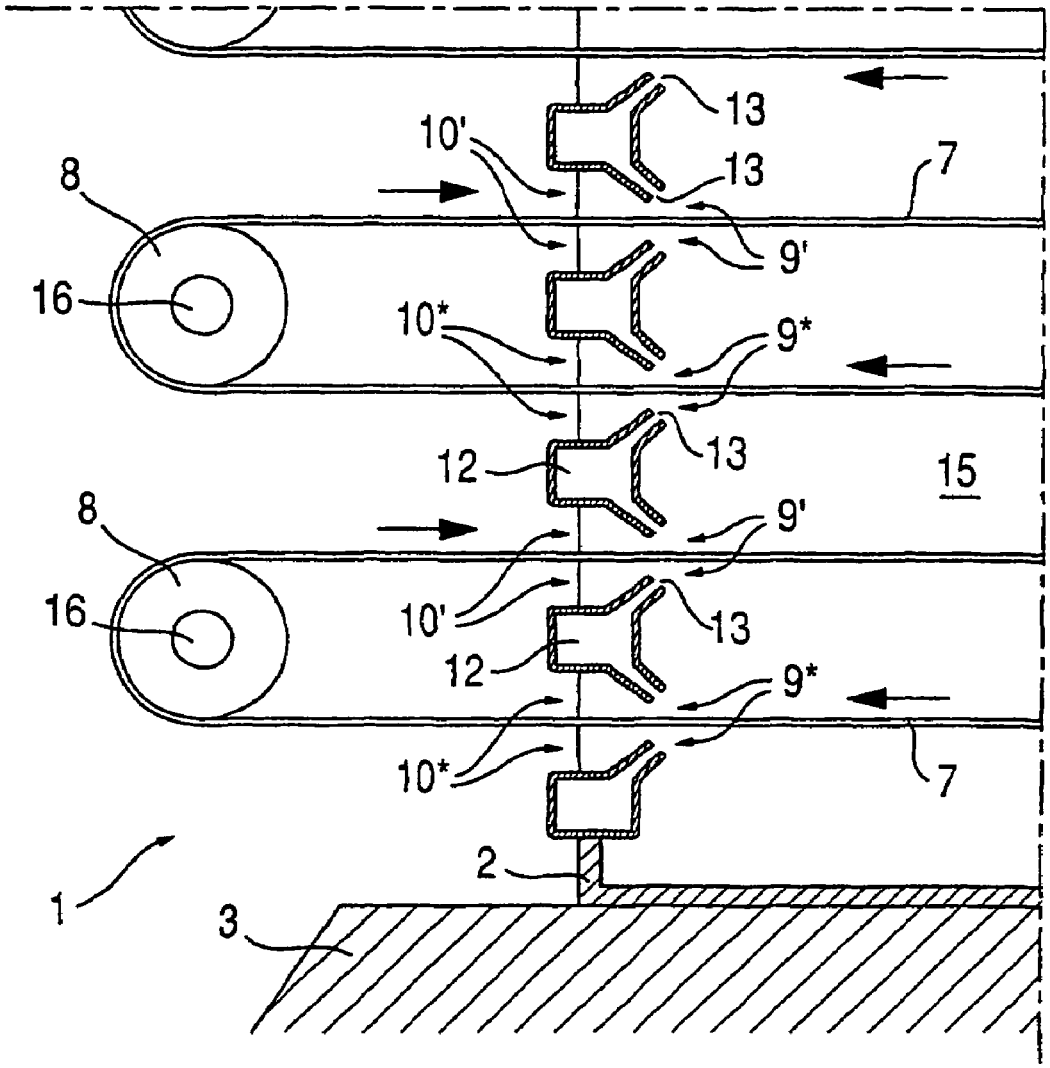
Fig. 4 PRIOR ART
FIG. 4 is a partial, transverse sectional view taken through a region in the vicinity of the openings of a reactor for the continuous treatment of strips of material perpendicular to the transverse extension of the strips of material and the transporting and reversing rollers, according to the prior art.

A portion of the reactor foundation 3, part of the reactor housing 2 in the form of a front face, the strip of material 7 and the transporting and reversing rollers 8 for the strip of material 7 can be seen in FIG. 4. The strip of material 7 is conveyed into the reactor through the openings 10' and is conveyed from the reactor through the openings 10*. The gas feedlines and distribution devices 12 together with the nozzles 13 through which the gas for the gas curtains 9'; 9* leaves, serve to generate and maintain the gas curtains 9'; 9*. The gas guide bodies or deflectors according to the invention are omitted in this case. It can easily be seen that the gas leaving the nozzles 13 is not passed to a gas guide space, and that no elevated pressure can build up in the latter and thus also no effective gas barrier can form.

Instead, the gas is distributed randomly and very rapidly, accompanied by eddy formations in the large interior of the reactor 15, without the gas curtain generated in this way providing a really effective seal against the escape of portions of the reactor atmosphere.

Figure 5:
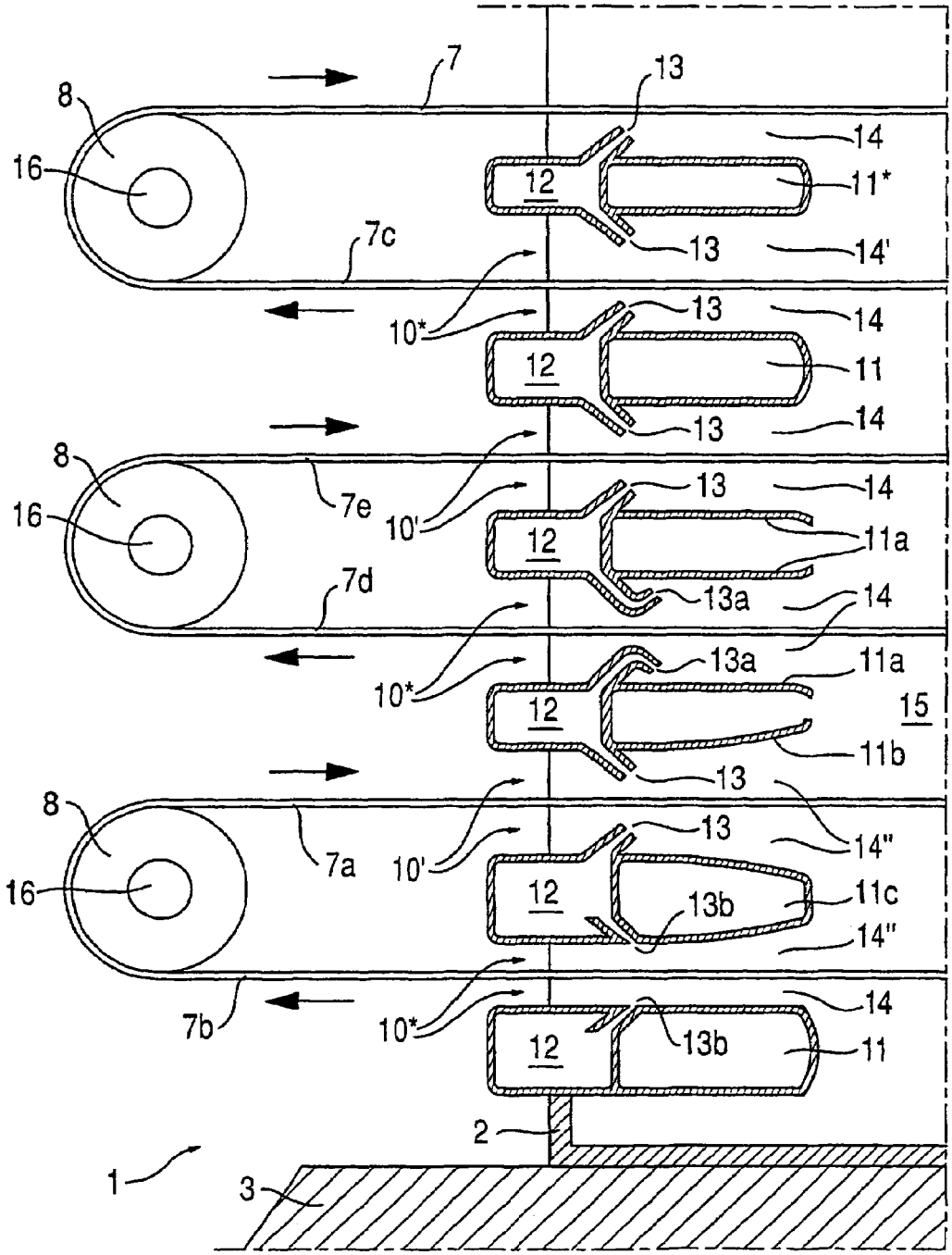
FIG. 5 is a partial, transverse sectional view through a region in the vicinity of the openings of a reactor according to the invention for the continuous treatment of strips of material perpendicular to the transverse extension of the strips of material and the reversing and transporting rollers.

The illustration shown in FIG. 5 is similar to that of FIG. 4. The basic difference compared to FIG. 4 is that in this case the gas guide bodies 11; 11*a*; 11*b*; 11*c* according to the invention are present. The gas guide bodies 11; 11*a*; 11*b*; 11*c* together with the strips of material 7 define gas guide spaces 14; 14'; 14". The gas guide spaces 14; 14'; 14" are generated for the most part to prevent an undesirable escape of gases from the interior of the reactor. Here too there can be recognized a part of the reactor wall 2 in the form of a front face, the reactor foundation 3, the transporting and reversing rollers 8, the strip of material 7 as well as the part sections 7*a*; 7*b*; 7*c*; 7*d*; 7*e* of the strip of material 7, the reactor openings 10'; 10*, and the gas feedline and distribution device 12 via which the gas outlet openings or nozzles 13; 13*a*; 13*b* are supplied with "curtain gas". Various possible configurations for the gas guide bodies, gas guide spaces, and nozzle positions have simply been reproduced here in one figure for illustrative purposes. However, this does not mean that this application specification teaches that such a multiplicity of possibilities has to be realized in practice in one reactor. The gas guide bodies 11: 11* are closed on all sides and their surfaces facing the strip of material 7 and the section 7*c* of the strip of material are flat and are disposed so that gas guide spaces 14; 14' are formed in which constant interspacings exist between the gas guide bodies 11 and the strips of material 7; 7*c* over the whole length and width of the gas guide bodies. In this connection, the gas guide space 14' is larger than the gas guide space 14. The gas guide bodies 11*a* are constructed as plates that enclose a space that is open to the interior of the reactor. Here, too, the surfaces facing the sections of the strips of material 7*e* and 7*d* are flat and are configured so as to form gas guide spaces 14 in which there are constant and uniform interspacings between the gas guide bodies 11 and the sections of strips of material 7*e* and 7*d* over the whole length and width of the gas guide bodies. Another embodiment is illustrated at the section of the strip of material 7*a*. This section 7*a* is flanked on both sides by two gas guide bodies 11*b*; 11*c* whose surfaces curve in a convex manner in the direction of the interior of the reactor so as to form gas guide spaces of uniform geometry 14" that open out increasingly towards the interior of the reactor. The gas guide body 11*b* is formed as a curved plate and together with the adjacent gas guide body 11*a* encloses a space that is open to the interior of the reactor but which is not a gas guide space. The gas guide body 11*c* has, on the other hand, on its two flat sides the same convexly curved surfaces and encloses a closed space. The section of the strip of material 7*b* is flanked on both sides by two differently shaped gas guide bodies 11*c*; 11. On one side of the section of the strip of material 7*b*, the gas guide body 11*c* forms a gas guide space 14" that opens out increasingly towards the interior of the reactor, while the gas guide body 11 on the other side, together with the section of the strip of material 7*b*, forms a gas space 14 of constant height over the length and width of the gas guide body 11. Another example of dissimilar gas guide spaces is illustrated in the section of the strip of material 7*c*. The gas guide bodies 11; 11* flanking the section of the strip of material 7*c* have the same shape but each of them has a different, though constant over their width and length, interspacing relative to the section of the strip of material 7*c*. Gas seals with different gas guide spaces on a strip of material 7 are in general restricted to special cases. All gas guide bodies 11; 11*; 11*a*; 11*b*; 11*c* are preferably free of sharp edges and burrs at their end next to the interior of the reactor. These ends are slightly bent away from the strip of material 7.

Different shapes and configurations of gas outlet nozzles 13; 13*a*; 13*b* are also shown in FIG. 5. Either the nozzles 13 project slightly above the surface of the gas guide bodies 11, as can be seen in the section of the strip of material 7*c*, or the nozzles 13*a* project beyond the surface of the gas guide bodies 11*a* and, in addition, are bent so that the gas stream leaving the latter first of all strikes the surface of the gas guide bodies 11*a*, where it is reflected, and only thereafter reaches the surface of the strip of material 7*d* with a reduced gas pressure and thus in a substantially less turbulent manner. If for example, as is illustrated with the strip of material 7*b*, a very small spacing is to be maintained between the gas guide bodies 11*c*; 11, projecting nozzles would prevent this. In this case, the nozzles 13*b* are therefore sunk within the gas feedlines and distribution devices 12. The nozzles 13; 13*a*; 13*b* are preferably slit-shaped nozzles that extend over the whole width of the material inlet and outlet openings. Other shapes of nozzles may however also be employed.

Figure 6:
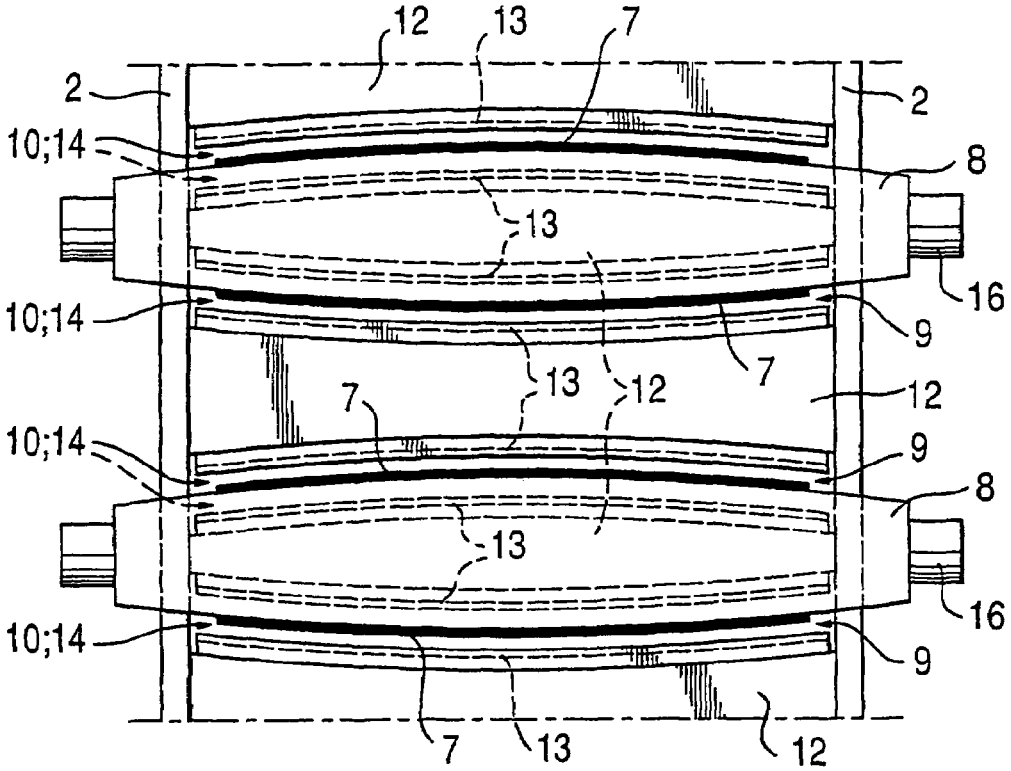
FIG. 6 is a plan view of a front face of a reactor in which the strips of material are convexly curved.

In many cases, the strips of material are bowed, because for example they are transported and deflected by rollers that either have a convex or a concave surface. FIG. 6 shows an example of strips of material having convexly bowed surfaces. The reactor is indicated by the sides of the reactor housing 2. In addition, two transporting and reversing rollers 8 together with their shaft butts 16 can be seen. The strip of material 7 is bowed at least in the region of the reactor openings 10 like the rollers 8 and accordingly the equipment parts that have to generate and maintain the gas curtain also match this curvature. Consequently, the gas feedlines and distribution devices 12, the nozzles 13 and also the surfaces (not visible here) that delimit the gas guide spaces 14 behind the material inlet and outlet openings 10 have to be shaped in a curved manner so as to meet the requirements for the functional capability of the gas seal according to the invention.

Figure 7:
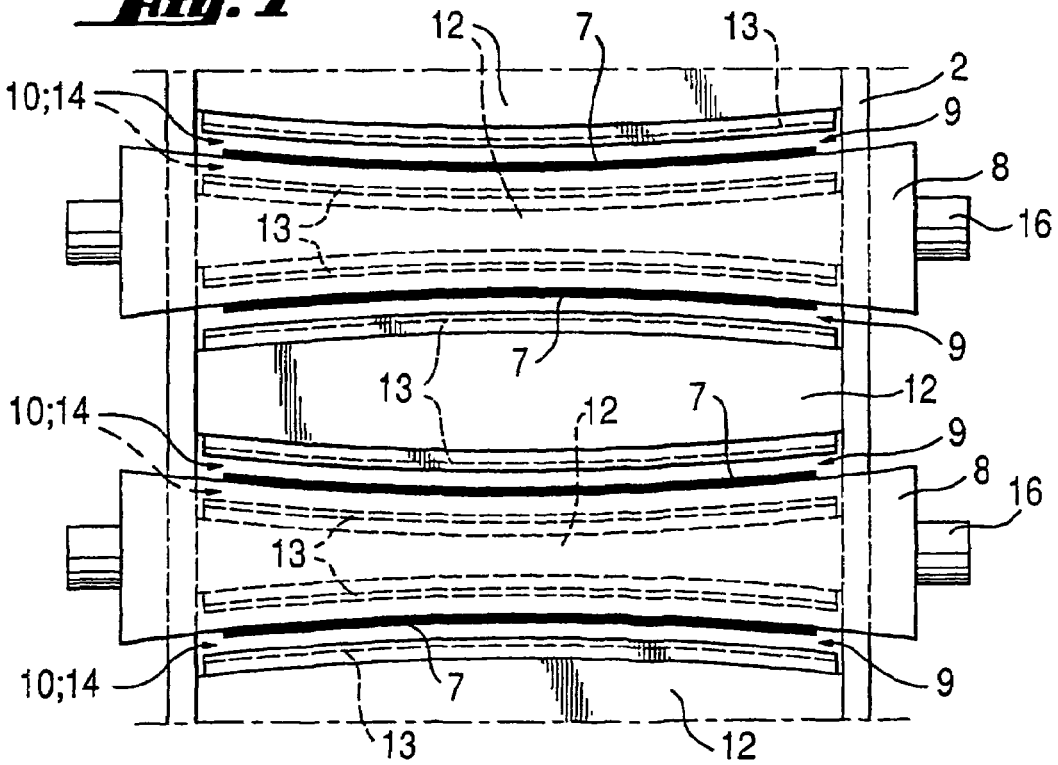
FIG. 7 is a plan view of a front face of a reactor in which the strips of material are concavely bowed.

FIG. 7 corresponds to FIG. 6 except that the strips of material 7 are bowed concavely. With regard to the description, reference should be made to the text for FIG. 6. In interpreting FIG. 7, references to convex in FIG. 6 have to be interpreted as concave where appropriate.

Figure 8:
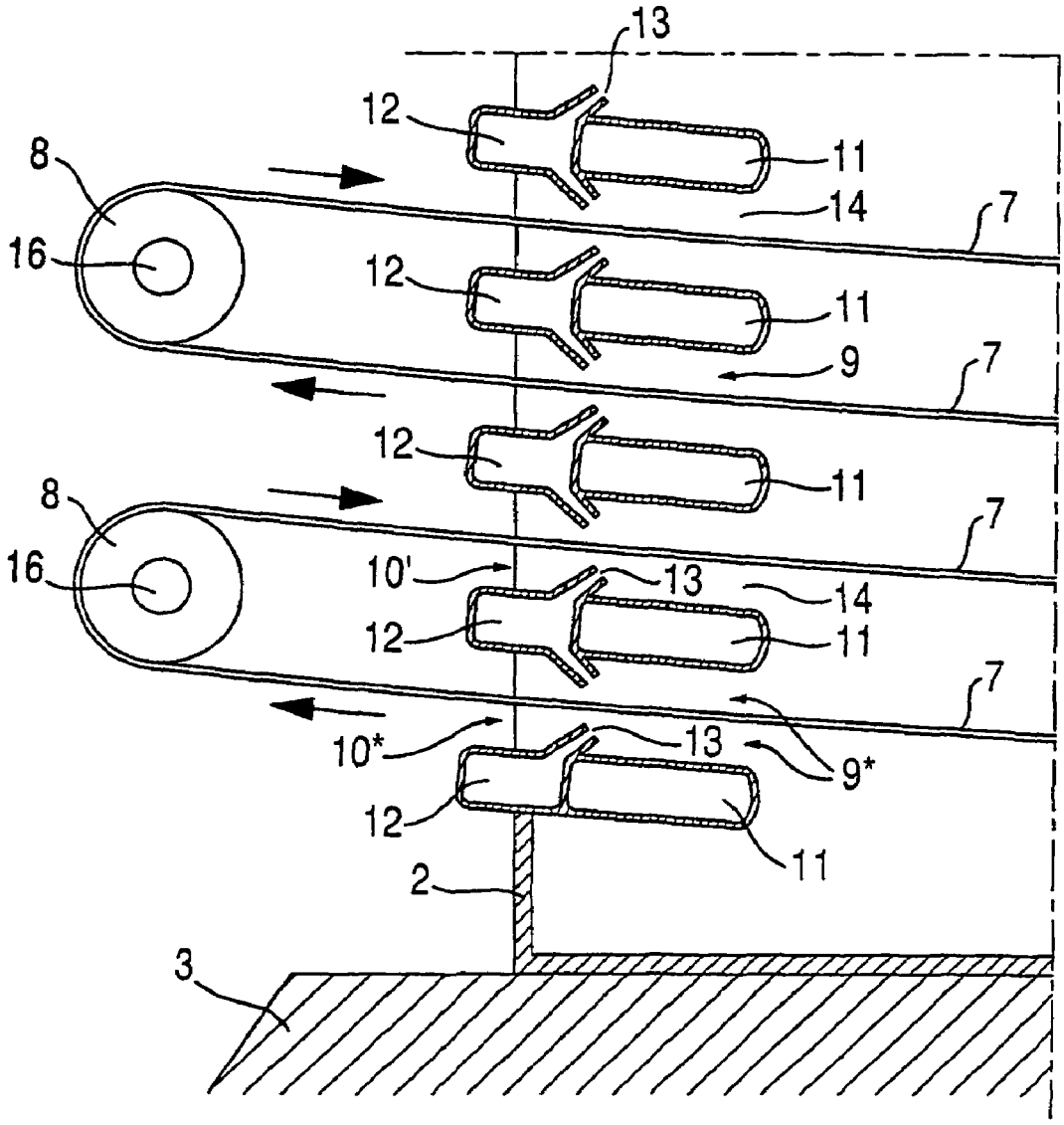
FIG. 8 is a partial, sectional view showing sagging strips of material, guided perpendicular to the transverse extension of the transporting and reversing rollers for the strips of material and perpendicular to the transverse extension of the strips of material.

Strips of material may often not be guided so tightly that they do not sag between their supporting zones, for example the transporting and reversing rollers 8. This means however that there are non-uniform interspacings between the strips of material and the gas guide bodies at the gas seals, resulting in dissimilar gas guide spaces on both sides of the strips of material. Accordingly, the effectiveness of the gas seals may be reduced. In order to counteract this, the surfaces of the gas guide bodies 11 are bowed (not shown) corresponding to the curvature of the strips of material 7 produced by the sag, and/or the gas guide bodies 11 are installed in a suitably inclined manner, as can be seen in FIG. 8, so that the desired, generally constant interspacings are again established on both sides of the strips of material 7.

Figure 9:
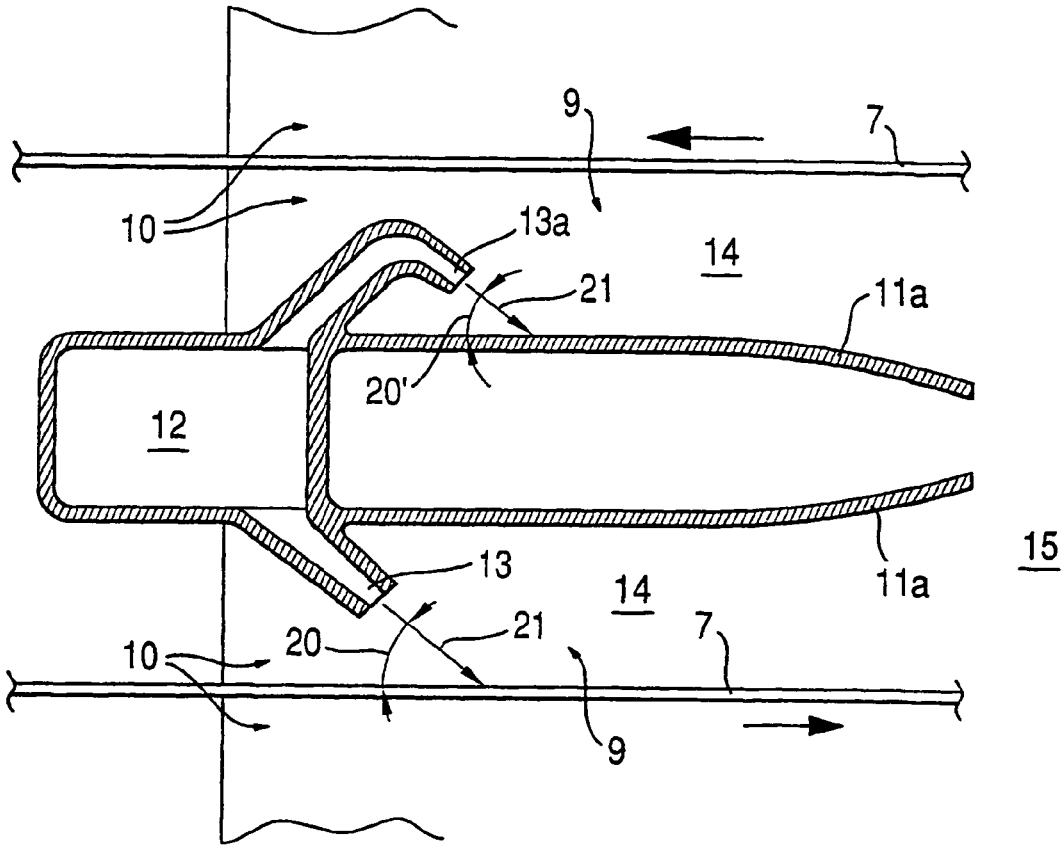
FIG. 9 is a partial, sectional view of a guide perpendicular to the transverse extension of the transporting and reversing rollers for the strips of material and perpendicular to the transverse extension of the strips of material, illustrating the impact angle of the gas stream.

FIG. 9 shows a section illustrating the angle 20; 20' at which the gas steam coming from the gas outlet openings 13 or nozzles 13; 13*a* strikes the strip of material 7 or, in the case of curved nozzles 13*a*, strikes the surfaces of the adjacent gas guide bodies 11*a*. The strip of material 7 and the gas feedlines and distribution devices 12 can also be seen. After leaving the straight nozzles 13, the gas stream 21 strikes the strip of material 7 at an angle 20 of 40° and after leaving the bent nozzles 13*a* strikes the surfaces of the gas guide bodies 11*a* at an angle 20' of 45°.

FIGS. 1 to 9 show only some of the possible modifications of the invention according to the basic idea of the invention. All other variants of the invention that are obvious to the person skilled in the art but which cannot be diagrammatically illustrated here should however be regarded as within the scope of this application.

The improved efficiency of the gas seal according to the invention will be illustrated hereinafter by using two sets of measurements made in a reactor for the continuous oxidation of strips of polyacrylonitrile fibers in order to render them non-meltable:

The strips of material were led horizontally through the reactor and in both series of measurements were subjected to a temperature increase from 180° to 265° C. The oxidizing agent was air. Gaseous hydrogen cyanide (HCN), a highly toxic gas, was among other products, released in the reaction occurring in the reactor. The efficiency of the gas seals at the material inlet and outlet openings was determined by measuring the HCN concentration in the centre of the uppermost material inlet opening at a distance of 10 cm from the inlet gap. This measurement site was chosen since a particularly high concentration of HCN would necessarily exist there because of the formation of an outwardly directed convection current at the front face of the furnace that entrains the gases possibly escaping from the material inlet and outlet openings as well as the harmful gases. The strips of material were transported a total of twenty-three times (23×) horizontally through the reactor by the transporting and reversing rollers situated outside the heated interior of the reactor. The reactor accordingly contained a total of forty six (46) such openings, i.e. the material inlet and outlet openings at the front and rear sides of the reactor, each of which openings was sealed by a gas curtain. Air at room temperature also served as a device for generating the gas curtain at the material inlet and outlet openings. The "curtain gas" left the nozzles, which where formed as slit-shaped nozzles, at an initial velocity of 105 m/sec and flowed directly against the strips of material. The two-dimensional gas jet flowing from the nozzles struck the strips of material at an angle of 45°.

In a first operational test, the material inlet and outlet openings of the reactor were sealed with gas curtains according to the prior art. In this case, a mean HCN concentration of 15 ppm was measured (mean value of 15 measurements).

Since the HCN values measured in this first test were far too high having regard to operational and environmental safety, all the gas seals of the reactor were replaced by gas seals according to the invention. Sealed gas guide bodies were incorporated, as are shown in FIG. 5 by the reference numeral 11. The length of the gas guide bodies was 120 mm, and the distance between their surfaces and the strips of material was 25 mm. A second operational test was then carried out. All the operating conditions were the same as in the first test. The only difference compared to the first test was the presence of the gas guide bodies at the gas curtains. An HCN concentration of 2 ppm was now measured at the same measurement site under identical measurement conditions, this measurement value being calculated from a total of 16 individual measurements.

By comparing the measurement results of the first operational test (15 ppm HCN) with those of the second operational test (2 ppm HCN), it can be seen that a very substantial improvement in the effectiveness of the gas seals of the described type can be achieved by using the solution according to the invention. The concentration of the gases discharged from the interior of the reactor into the surrounding atmosphere at these seals equipped with gas curtains was reduced by a factor of ten (10).

I claim:

1. In a reactor for treating strands or strips of material having a surface, the reactor including:

an outer jacket extending parallel to a transportation direction of the strands or strips of the material;

two opposing walls, at least one of the walls having an opening for passing the strands or strips of material therethrough;

devices for transporting the strands or strips of material through the reactor;

devices for transporting the strands or strips of material relative to the reactor;

devices for transporting gases relative to a reactor space; and a gas feedline and distribution device disposed at the opening and having gas discharge openings, the gas feedline and distribution device being configured to outflow a gas stream at the gas discharge openings to generate a gas curtain for preventing undesirable substances from crossing the gas curtain relative to the reactor space;

a gas seal, comprising:

a deflector or gas guide body of the gas feedline and distribution device:

extending toward an interior of the reactor;

disposed behind the gas discharge openings of the gas feedline and distribution device relative to the interior of the reactor; and disposed at a distance from the respective surfaces of the strands or strips of material.

2. The gas seal according to claim 1, wherein the opposing two walls are a front wall and a rear wall.

3. The gas seal according to claim 1, wherein the opposing two walls are an upper and a lower seal wall.

4. The gas seal according to claim 1, wherein the opening in the at least one of the walls is for removing the strands (7) or strips of material.

5. The gas seal according to claim 1, wherein the devices for transporting the strands or strips of material transport the strands or strips of material to the reactor.

6. The gas seal according to claim 1, wherein the devices for transporting the strands or strips of material transport the strands or strips of material from the reactor.

7. The gas seal according to claim 1, wherein the reactor includes devices for heating at least one of the interior of the reactor, parts of the interior of the reactor, the strands or strips of material, and parts of the strands or strips of material.

8. The gas seal according to claim 1, wherein the reactor includes devices for cooling at least one of the interior of the reactor, parts of the interior of the reactor, the strands or strips of material, and parts of the strands or strips of material.

9. The gas seal according to claim 1, wherein the reactor includes no devices for heating and no devices for cooling the interior of the reactor, parts of the interior of the reactor, the strands or strips of material, and parts of the strands or strips of material.

10. The gas seal according to claim 1, wherein the devices for transporting gases relative to the reactor space are devices for supplying the gases to the reactor space.

11. The gas seal according to claim 1, wherein the devices for transporting gases relative to the reactor space are devices for removing the gases from the reactor space.

12. The gas seal according to claim 1, wherein the gases being transported are temperature-regulated.

13. The gas seal according to claim 1, wherein the gases being transported are non-temperature-regulated.

14. The gas seal according to claim 1, wherein the gas curtain generated by said gas feedline and distribution device prevents the undesirable substances from entering the reactor space.

15. The gas seal according to claim 1, wherein the gas curtain generated by said gas feedline and distribution device prevents the undesirable substances from exiting the reactor space.

16. The gas seal according to claim 1, wherein said deflector or gas guide body has at least one surface adjacent the strands or strips of material and lying at a geometrical level equaling the gas discharge openings of the gas feedline and distribution device.

17. The gas seal according to claim 1, wherein said deflector or gas guide body has at least one surface adjacent the strands or strips of material and laying at a level different from a geometrical level of the gas outlet opening.

18. The gas seal according to claim 1, wherein:

the reactor is a horizontally operating reactor; and said deflector or gas guide body is a constituent part of the horizontally operating reactor.

19. The gas seal according to claim 1, wherein:

the reactor is a vertically operating reactor; and said deflector or gas guide body is a constituent part of the vertically operating reactor.

20. The gas seal according to claim 1, further comprising devices for circulating gaseous contents of the interior of the reactor.

21. The gas seal according to claim 1, wherein the reactor is a furnace.

22. The gas seal according to claim 1, wherein:

said deflector or gas guide body has a surface area; and said deflector or gas guide body is disposed parallel to the gas feedline and distribution device to maintain constant interspacing with the strands or strips of material throughout said surface area.

23. The gas seal according to claim 1, wherein said deflector or gas guide body is made from a material selected from the group consisting of a metal, a metal alloy, a ceramic, glass, a composite material, and a plastic.

24. The gas seal according to claim 1, wherein said deflector or gas guide body is formed from a textile composite selected from the group consisting of fibers, threads, yarns, and wires.

25. The gas seal according to claim 24, wherein said deflector or gas guide body includes a fabric made from at least one of fibers, threads, and wires; the fabric further being made from a material selected from the group consisting of steel, stainless steel, copper, brass, bronze, silicon dioxide, silicon carbide, aluminum oxide, glass, and mineral fibers.

26. The gas seal according to claim 1, wherein:

the strands or strips of material have a flat side; and said deflector or gas guide body is disposed proximate the flat side of the strands or strips of material.

27. The gas seal according to claim 26, wherein:

the strands or strips of material have a further flat side; and a further deflector or gas guide body is disposed only on one of the flat sides of the strands or strips of material.

28. The gas seal according to claim 1, wherein:

the strands or strips of material have a flat side; and said deflector or gas guide body is only disposed on the flat side of the strands or strips of material.

29. The gas seal according to claim 28, wherein:

the strands or strips of material have a further flat side; and at least one further deflector or gas guide body is disposed on the further flat side of the strand or strip of material.

30. The gas seal according to claim 1, wherein said deflector or gas guide body has a flat surface and ends and edges facing the interior of the furnace, the ends and edges being rounded and free from burrs.

31. The gas seal according to one or more of claim 1, wherein said deflector or gas guide body has a bowed surface and ends and edges facing the interior of the furnace, said ends and edges being rounded and free from burrs.

32. The gas seal according to claim 1, wherein said deflector or gas guide body has a smooth surface.

33. The gas seal according to claim 1, wherein said deflector or gas guide body has an anti-adhesion coating.

34. The gas seal according to claim 1, wherein said deflector or gas guide body is protected against corrosion.

35. The gas seal according to claim 1, wherein said deflector or gas guide body is formed as a heating body.

36. The gas seal according to claim 1, wherein said deflector or gas guide body is formed as a cooling body.

37. The gas seal according to claim 1, wherein the distance of said deflector or gas guide body from the surface of a directly adjacent one of the strands or strips of material is at least 5 mm.

38. The gas seal according to claim 1, wherein the distance of said deflector or gas guide body from the surface of a directly adjacent one of the strands or strips of material is between 15 and 40 mm.

39. The gas seal according to claim 1, further comprising a further deflector or gas guide body disposed on an opposite side of a directly adjacent one of the strands or strips of material;

the distance of said deflector or gas guide body from the surface of the immediately adjacent one of the strands or strips of material differing from a distance of the further deflector or gas guide body from the opposite side of the strand or strip of material.

40. The gas seal according to claim 1, wherein:

said deflector or gas guide body has a length; and a ratio of said length of said deflector or gas guide body to said distance from the surface of the directly adjacent strand or strip of material to said deflector or gas guide body is at most 10:1.

41. The gas seal according to claim 40, wherein said ratio of said length of said deflector or gas guide body to said distance from the surface of the directly adjacent strand or strip of material to said deflector or gas guide body is between 4:1 and 6:1.

42. The gas seal according to claim 1, further comprising a further deflector or gas guide body disposed directly adjacent said deflector or gas guide body and on a side of said deflector or gas guide body from a given one of the strips or strands of material immediately adjacent said deflector or gas guide body;

said deflector or gas guide body being installed and shaped so a desired first distance to the immediately adjacent one of the strips or strands of material and a second distance to said further deflector or gas guide body is largely maintained when the strand or strip of material sags.

43. The gas seal according to claim 42, wherein said nozzles are configured to direct the gas stream leaving said nozzles at an angle relative to the interior of the reactor and form with the surface of a directly adjacent one of the strands or strips of material an angle ranging from 40° to 50°.

44. The gas seal according to claim 1, wherein gas leaves said gas distribution device from directed nozzles.

45. The gas seal according to claim 44, wherein said nozzles are configured to direct the gas stream leaving said nozzles at an angle relative to the interior of the reactor and form with the surface of the directly adjacent one of the strands or strips of material an angle ranging from 30° to 60°.

46. The gas seal according to claim 44, wherein said nozzles are bent gas outlet openings and form with a surface of said deflector or gas guide body an angle ranging from 30° to 60°.

47. The gas seal according to claim 44, wherein said nozzles are bent gas outlet openings and configured to direct the gas stream leaving said nozzles at an angle relative to the interior of the reactor and form with the surface of said deflector or gas guide body an angle ranging from 40° to 50°.

48. The gas seal according to claim 1, wherein said nozzles or gas outlet openings are configured to impart an initial velocity of 50 to 140 m/sec to the gas stream.

49. The gas seal according to claim 48, wherein the temperature-regulated gas is temperature regulated by using a heat content of gases and vapors leaving the reactor.

50. The gas seal according to claim 1, wherein the gas stream is a temperature-regulated gas.

51. The gas seal according to claim 1, wherein the gas stream is a gas at normal temperature.

52. The gas seal according to claim 1, wherein the gas stream is operated with a gas derived at least in part from the interior of the furnace.

53. A reactor for treating strands or strips of material having a surface, comprising:

an outer jacket extending parallel to a transportation direction of the strands or strips of the material;

two opposing walls, at least one of said walls having an opening for passing the strands or strips of material therethrough;

devices for transporting the strands or strips of material through the reactor;

devices for transporting the strands or strips of material relative to the reactor;

devices for transporting gases relative to a reactor space;

a gas feedline and distribution device disposed at said opening and having gas discharge openings, said gas feedline and distribution device being configured to outflow a gas stream at said gas discharge openings to generate a gas curtain for preventing undesirable substances from crossing said gas curtain relative to said reactor space;

a gas seal including a deflector or gas guide body of said gas feedline and distribution device extending toward an interior of the reactor, disposed behind said gas discharge openings of said gas feedline and distribution device relative to said interior of the reactor, and disposed at a distance from the respective surfaces of the strands or strips of material.

* * * * *